US009963989B2

(12) United States Patent
Banks et al.

(10) Patent No.: US 9,963,989 B2
(45) Date of Patent: May 8, 2018

(54) GAS TURBINE ENGINE VANE-TO-TRANSITION DUCT SEAL

(71) Applicant: United Technologies Corporation, Hartford, CT (US)

(72) Inventors: Anton G. Banks, Manchester, CT (US); Robert L. Hazzard, Windsor, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 930 days.

(21) Appl. No.: 14/296,657

(22) Filed: Jun. 5, 2014

(65) Prior Publication Data

US 2014/0366556 A1 Dec. 18, 2014

Related U.S. Application Data

(60) Provisional application No. 61/833,957, filed on Jun. 12, 2013.

(51) Int. Cl.
*F01D 11/00* (2006.01)
*F01D 25/24* (2006.01)

(52) U.S. Cl.
CPC ..... *F01D 11/005* (2013.01); *F01D 25/246* (2013.01)

(58) Field of Classification Search
None
See application file for complete search history.

(56) References Cited

U.S. PATENT DOCUMENTS 2,984,454 A * 5/1961 Fiori ..... F01D 9/042 415/117
3,042,367 A * 7/1962 Welsh ..... F01D 11/001 415/113
4,318,668 A * 3/1982 Chaplin ..... F01D 25/14 415/135
4,425,078 A * 1/1984 Robbins ..... F01D 11/005 277/628
4,627,233 A * 12/1986 Baran, Jr. ..... F01D 25/14 415/115
4,643,638 A 2/1987 Laurello
4,921,401 A * 5/1990 Hall ..... F01D 9/04 403/28
5,192,185 A * 3/1993 Leonard ..... F01D 11/08 415/170.1
5,470,198 A 11/1995 Harrogate et al.
7,246,995 B2 * 7/2007 Zborovsky ..... F01D 9/023 415/137
7,296,967 B2 11/2007 Shapiro
7,303,371 B2 * 12/2007 Oltmanns ..... F01D 11/005 415/191

(Continued)

FOREIGN PATENT DOCUMENTS

WO 2011153393 12/2011

*Primary Examiner* — Phutthiwat Wongwian
*Assistant Examiner* — Jessica Kebea
(74) *Attorney, Agent, or Firm* — Carlson, Gaskey & Olds, P.C.

(57) ABSTRACT

A vane seal assembly for a gas turbine engine comprises of a case including a first connector. A notch in the case adjoins the groove. A vane having a second connector mates with the first connector. A seal assembly is provided between the vane and the case to provide a sealed cavity adjoining the notch.

11 Claims, 2 Drawing Sheets

(56) References Cited

U.S. PATENT DOCUMENTS

| | | | | |
|---|---|---|---|---|
| 7,360,988 | B2 * | 4/2008 | Lee | F01D 9/00 29/889.22 |
| 9,366,444 | B2 * | 6/2016 | Salunkhe | F01D 9/023 |
| 2007/0134090 | A1 * | 6/2007 | Heyward | F01D 9/023 415/209.2 |
| 2011/0081237 | A1 | 4/2011 | Durocher et al. | |
| 2012/0292862 | A1 | 11/2012 | Moochrie et al. | |
| 2014/0119902 | A1 * | 5/2014 | Feldmann | F01D 11/08 415/173.1 |
| 2015/0102565 | A1 * | 4/2015 | Feldmann | F01D 25/246 277/591 |
| 2016/0032746 | A1 * | 2/2016 | Jenkins | F01D 25/246 415/173.1 |
| 2016/0312640 | A1 * | 10/2016 | Clouse | F01D 11/005 |

* cited by examiner

GAS TURBINE ENGINE VANE-TO-TRANSITION DUCT SEAL

CROSS-REFERENCE TO RELATED APPLICATIONS

This application claims priority to U.S. Provisional Application No. 61/833,957, which was filed on 12 Jun. 2013 and is incorporated herein by reference.

BACKGROUND

This disclosure relates to a seal for a gas turbine engine, such as an industrial gas turbine engine. More particularly, the disclosure relates to a seal that, in one example application, is used between stator vanes and a transition duct.

A gas turbine engine typically includes a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and a ground-based generator for industrial gas turbine engine applications.

One example turbine section includes high and low pressure turbine sections. A transition duct is arranged between the high and low pressure turbine sections to communicated core flow gases. A circumferential array of vanes may be provided at forward and/or aft locations of the transition duct and are typically supported by an outer case of the engine's static structure.

An outer end of the vanes may include a hook which is received within a corresponding groove in the outer case. One example outer case may include circumferentially arranged, axially extending thermal stress relief notches that adjoin the groove. Cooling fluid, such as bleed air, is typically provided through the outer case to the vanes in an area of the groove to cool the vanes. The notch may permit the cooling fluid to undesirably leak through the notch into an adjoining cavity, which reduces the efficiency of the engine.

SUMMARY

In one exemplary embodiment, a vane seal assembly for a gas turbine engine comprises of a case including a first connector. A notch in the case adjoins the groove. A vane having a second connector mates with the first connector. A seal assembly is provided between the vane and the case to provide a sealed cavity adjoining the notch.

In a further embodiment of any of the above, the first and second connectors respectively provide a groove and a hook.

In a further embodiment of any of the above, the vane includes a lip. The vane seal assembly comprises a transition duct having a slot for receiving the lip. The vane supports the transition duct relative to the case.

In a further embodiment of any of the above, the seal assembly is secured to the transition duct and seals against the case and the vane.

In a further embodiment of any of the above, the seal assembly is secured to the transition duct by a weld.

In a further embodiment of any of the above, the seal assembly includes first and second seal portions in engagement with one another.

In a further embodiment of any of the above, the first portion includes a bend that provides a leg. The second portion seals against the leg.

In a further embodiment of any of the above, the second seal portion includes first and second bends that provide first and second arms. The first arm seals with respect to the first seal portion. The second arm seals against the vane.

In a further embodiment of any of the above, the first seal portion provides a fishmouth for receiving an end of the second seal portion.

In a further embodiment of any of the above, the first seal portion is secured to the case by threaded fasteners.

In a further embodiment of any of the above, the case includes a flange. The seal assembly engages the flange.

In a further embodiment of any of the above, the vane includes a surface. The seal assembly engages the surface.

In another exemplary embodiment, a gas turbine engine includes a compressor and turbine sections. A combustor is provided axially between the compressor and turbine sections. The turbine section includes a case having a groove. A vane includes a hook received in the groove. A seal assembly is provided between the vane and the case to provide a sealed cavity.

In a further embodiment of any of the above, the first and second connectors respectively provide a groove and a hook.

In a further embodiment of any of the above, the case includes a notch that adjoins the groove and is configured to provide thermal stress relief of the case. The seal assembly adjoins the notch.

In a further embodiment of any of the above, the gas turbine engine comprising a cooling source configured to provide cooling fluid through the case to a cooling cavity adjacent to the sealed cavity. The seal assembly blocks flow through the notch.

In a further embodiment of any of the above, the turbine section includes a transition duct supported relative to the case by the vane. The seal assembly is secured to the transition duct and seals against the case and the vane.

In a further embodiment of any of the above, the seal assembly includes first and second seal portions in engagement with one another.

In a further embodiment of any of the above, the second seal portion includes first and second bends providing first and second arms. The first arm seals with respect to the first seal portion. The second arm seals against the vane.

BRIEF DESCRIPTION OF THE DRAWINGS

The disclosure can be further understood by reference to the following detailed description when considered in connection with the accompanying drawings wherein.

DETAILED DESCRIPTION

Figure 1:
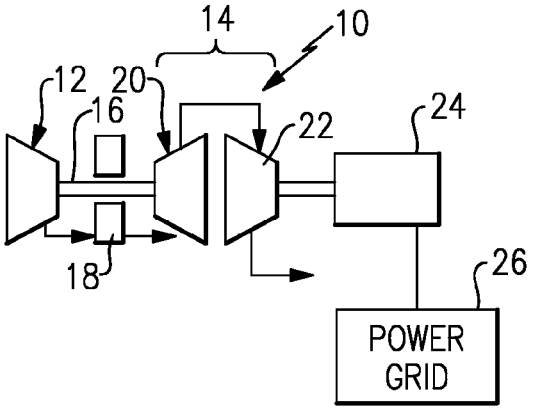
FIG. 1 is a schematic view of an example industrial gas turbine engine.

A schematic view of an industrial gas turbine engine 10 is illustrated in FIG. 1. The engine 10 includes a compressor section 12 and a turbine section 14 interconnected to one another by a shaft 16. A combustor 18 is arranged between the compressor and turbine sections 12, 14. The turbine section 14 includes first and second turbines that correspond to high and low pressure turbines 20, 22.

A generator 24 is rotationally driven by a shaft coupled to the low pressure turbine 22, or power turbine. The generator 24 provides electricity to a power grid 26. It should be understood that the illustrated engine 10 is highly schematic, and may vary from the configuration illustrated. Moreover, the disclosed seal assembly may be used in commercial and military aircraft engines as well as industrial gas turbine engines.

Figure 2:
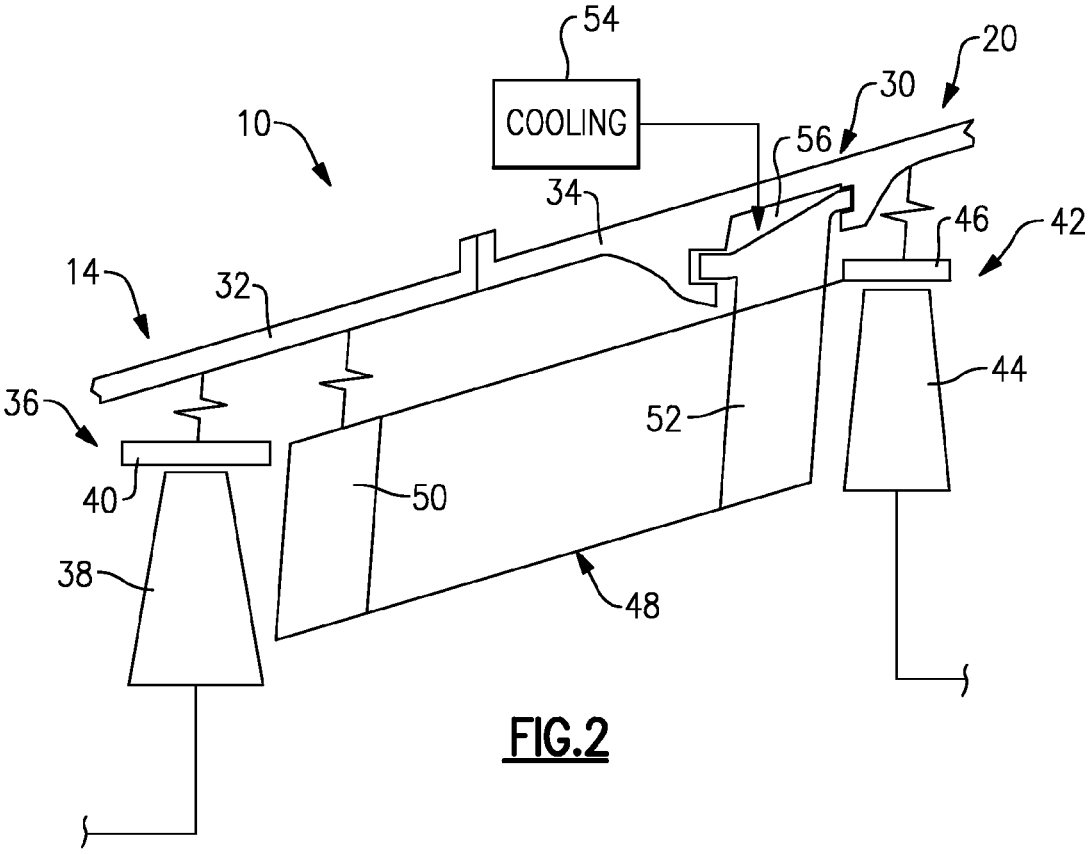
FIG. 2 is a schematic view of a portion of a turbine section including a transition duct arranged between high and low pressure turbine sections.

The gas turbine engine 10 is shown in more detail in the area of the turbine section in FIG. 2. An outer case 30 provides engine static structure and includes first and second case portions 32, 34, which may correspond to high and low pressure turbine cases. The first and second case portions are secured to one another at a flanged joint, for example. In one example, the outer case 30 is provided by a circumferentially continuous, unitary structure. A high pressure turbine stage 36 of the high pressure turbine section 14 includes a circumferential array of rotatable blades 38 that seal relative to the outer case 30 at a blade outer air seal 40, which is fixed relative to the outer case 30. A low pressure turbine stage 42 of the low pressure turbine section 20 includes a circumferential array of rotatable blades 44. The blades 44 seal relative to the outer case 30 at blade outer air seals 46 that are secured relative to the outer case 30.

A transition duct 48 is arranged within the outer case 30 and communicates fluid from the high pressure turbine 20 to the low pressure turbine 22. In one example, the transition duct is provided by multiple circumferentially arranged arcuate segments. First and second circumferential arrays of vanes 50, 52 are mounted at forward and aft locations of the transition duct 48 in the example.

A cooling source 54, such as bleed air from the compressor section 12, provides the cooling fluid to a cavity 56, which supplies cooling fluid to the vanes 52, for example.

Figure 3:
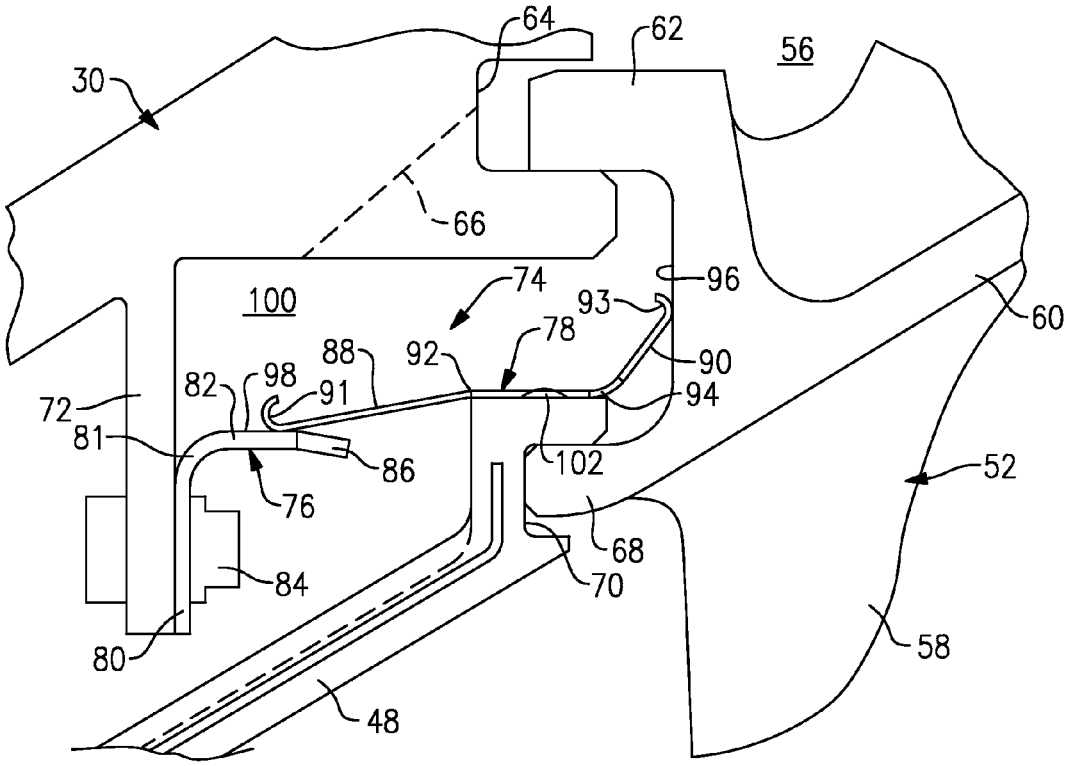
FIG. 3 is an example enlarged cross-sectional view of one example seal assembly.

Referring to FIG. 3, the vanes 52 include airfoils 58 extending radially inward from a platform 60. The vanes 52 may be configured to provide a single airfoil or may be arrange in clusters of multiple airfoils. Mating connectors support the vanes 52 on the outer case. In one example, the vanes 52 include at least one hook 62 received in a circumferential groove 64 in the outer case 30. An outer portion of the transition duct 48 is supported relative to the outer case 30 by the vanes 52. In one example, the vanes 52 include a lip 68 that is received in a slot 70 of the transition duct 48.

Multiple notches 66 are provided in the outer case 30 at spaced apart circumferential locations to relieve stresses due to thermal expansion and contraction of the turbine section components during engine operation. The notches 66 provide undesired fluid communication between the cavity 56 and an adjacent cavity 100.

A seal assembly 74 is provided between the outer case 30 and the vanes 52 to seal the cavity 56 from the cavity 100 and block the undesired leakage from the cavity 56 through the notch 66 to other portions of the gas turbine engine. The seal assembly 74 may be provided by arcuate segments that are interleaved with one another to seal the segments to one another.

In one example, a flange 72 extends from the outer case 30. The seal assembly 74 is provided by first and second seal portions 76, 78. The second seal portion 78 is attached to the transition duct 48 by weld, rivet, or bolt. The first seal portion 76 is mounted to the flange 72 by first fastening elements 84, which are threaded fasteners in one example. In one example, the first seal portion 76 includes first and second legs 80, 82 joined by a bend 81. An end 86 of the second leg 82 is canted radially inward to facilitate assembly of the engine.

The second seal portion 78 includes first and second arms 88, 90 secured to the transition duct 48 by a second fastening element 102, which in one example is a weld. The first arm 88 includes a first bend 92 that biases a first end 91 into engagement with the second leg 82 of the first seal portion 76. The second arm 90 includes a second bend 94 that biases a second end 93 into engagement with a surface 96 of the vane 52.

During assembly, the first seal portion 76 is secured to the outer case 30. The second seal portion 78 is secured to the transition duct 48. The transition duct 48 is inserted axially into the outer case 30 such that the second seal portion 78 engages and seals relative to the first seal portion 76. The canted end 86 of the second leg 82 accommodates the first arm 88 as the transition duct 48 is inserted into the outer case 30. The vane 52 is inserted axially into the outer case such that the lip 68 received in the slot 70, and the hook 62 is received in the groove 64. With the vane 52 mounted to the outer case 30, the second portion 78 seals against the vane 52. The bend 94 and having first end 91 slide on second leg 82 and canted end 86 at assembly permit sufficient compliance of the seal assembly 74 while avoiding plastic deformation of the seal assembly during assembly.

Figure 4:
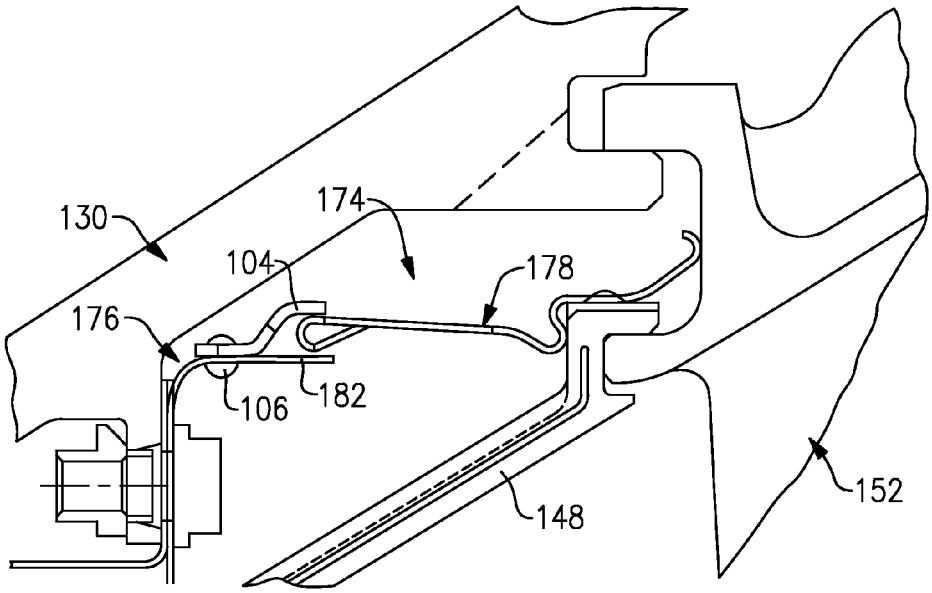
FIG. 4 is an enlarged cross-sectional view of another example seal assembly.

Another example seal assembly 174 is shown in FIG. 4. The first seal portion 176 includes a third leg 104 secured to the second leg 182 by third fastening elements 106, such as rivets, to provide a fishmouth that receives an end of the second portion 178. The second portion 178 is attached to the transition duct 148 by weld, rivet, or bolt. The seal assembly 174 provides a seal with respect to the outer case 130, transition duct 148 and vane 152, as described above with respect to FIG. 3.

The seal assembly 74 is constructed from a flexible material capable of providing the necessary deflection at the given operating temperature of that portion of the engine. The seal assembly 74 may be stamped, and includes a cross-sectional thickness in the range as required to provide proper contact at the first end 91 and the second end 93.

Although an example embodiment has been disclosed, a worker of ordinary skill in this art would recognize that certain modifications would come within the scope of the claims. For that reason, the following claims should be studied to determine their true scope and content.

What is claimed is:

1. A vane seal assembly for a gas turbine engine comprising:

a case including groove, and a notch in the case that adjoins the groove, and the case has a flange axially spaced from the groove;

a vane having a hook received in the groove;

a seal assembly provided between the vane and the case to provide a sealed cavity adjoining the notch, the seal assembly includes first and second seal portions in engagement with one another, the first seal portion is L-shaped and has first and second legs joined at a bend, the first leg secured to the flange, the second seal portion includes first and second arms, the first arm engaging the second leg, and the second arm engaging the vane; and a transition duct supported by the vane, the second seal portion secured to the transition duct at a location between the first and second arms.

2. The vane seal assembly according to claim 1, wherein the vane includes a lip, and the transition duct having a slot receiving the lip, the vane supporting the transition duct relative to the case.

3. The vane seal assembly according to claim 2, wherein the vane includes a radially extending surface between the hook and the lip, and the second arm engages the surface.

4. The vane seal assembly according to claim 3, wherein the first arm extends radially inward from the location, and the second arm extends radially outward from the location.

5. A vane seal assembly for a gas turbine engine comprising:

a case including a groove, and a notch in the case that adjoins the groove;

a vane having a hook mating with the groove;

a transition duct supported by the vane; and a seal assembly provided between the vane and the case to provide a sealed cavity adjoining the notch, wherein the seal assembly includes first and second seal portions, the second seal portion is secured to the transition duct and seals against the vane and the first seal portion, and the first seal portion seals against the case.

6. The vane seal assembly according to claim 5, wherein the second seal portion is secured to the transition duct by a weld.

7. The vane seal assembly according to claim 5, wherein the first seal portion comprises a bend and a leg, the second seal portion sealing against the leg.

8. The vane seal assembly according to claim 7, wherein the second seal portion comprises a first bend, a second bend, a first arm, and a second arm, the first arm sealing against the first seal portion, and the second arm sealing against the vane.

9. The vane seal assembly according to claim 5, wherein the first seal portion comprises a first leg and a second leg, wherein an opening is formed between the first and second legs, and the opening receiving an end of the second seal portion.

10. The vane seal assembly according to claim 5, wherein the first seal portion is secured to the case by threaded fasteners.

11. The vane seal assembly according to claim 10, wherein the case includes a flange, and first seal portion seals against the flange.

* * * * *